United States Patent [19]

Beach-Thomas

[11] 4,434,992

[45] Mar. 6, 1984

[54] TROLLEY FOR USE IN TRANSPORTING A BOAT

[75] Inventor: Anthony W. Beach-Thomas, Ross-on-Wye, England

[73] Assignee: John Rhys Hughes, Surrey, England

[21] Appl. No.: 256,231

[22] Filed: Apr. 21, 1981

[30] Foreign Application Priority Data

Nov. 28, 1980 [GB] United Kingdom ..... 8038228

[51] Int. Cl.[3] ..... B62B 1/26

[52] U.S. Cl. ..... 280/47.13 B; 114/344

[58] Field of Search ..... 280/47.13 B, 47.13 R, 280/47.14, 47.24, 47.32, 7.13, 7.12, 63, 414.2; 114/344; 441/74

[56] References Cited

U.S. PATENT DOCUMENTS

| | | | |
|---|---|---|---|
| 1,617,984 | 2/1927 | Biggio | 280/11.19 |
| 2,550,219 | 4/1951 | Bollinger | 280/47.13 R |
| 2,673,991 | 4/1954 | Dahlkvist | 114/344 |
| 2,966,368 | 12/1960 | Engnell | 280/47.13 B |
| 3,125,351 | 3/1964 | McDonough | 280/47.13 B |
| 3,135,560 | 6/1964 | Carlson | 114/344 |
| 3,406,985 | 10/1968 | Ballenger et al. | 280/47.13 B |
| 3,687,476 | 8/1972 | Abbott | 280/47.32 |
| 3,831,211 | 8/1974 | Bustamante | 114/344 |
| 3,977,690 | 8/1976 | Carn | 280/47.13 B |
| 4,243,239 | 1/1981 | Whitney | 280/47.13 B |

FOREIGN PATENT DOCUMENTS

| | | | |
|---|---|---|---|
| 2640236 | 3/1978 | Fed. Rep. of Germany | 280/47.13 R |
| 2929084 | 1/1980 | Fed. Rep. of Germany | 180/312 |
| 8372 | of 1910 | United Kingdom | 280/47.13 R |

OTHER PUBLICATIONS

Popular Science Nov. 1972, "Boat Dolly".

Hobie Hotline "Beach Wheels" p. 34, Jul., Aug. 1978.

*Primary Examiner*—David M. Mitchell

*Attorney, Agent, or Firm*—Young & Thompson

[57] ABSTRACT

A trolley for use in transporting, and particularly launching, a boat comprises a channel-sectioned hard rubber block which, in use, straddles the keelplate of the boat, and two-part rollers rotatable on opposite ends of a spindle which extends through the block. The trolley is secured to the keelplate by a slideable U-shaped detent element, the upper limb of which can be passed through registering holes in the side flanges of the block and in the keelplate. Various alternative detent arrangements may be employed.

3 Claims, 7 Drawing Figures

TROLLEY FOR USE IN TRANSPORTING A BOAT

BACKGROUND OF THE INVENTION

The invention relates to a trolley for use in transporting a boat and particularly to a trolley suitable for use in launching a small boat such as a sailing dinghy.

Hitherto trolleys for use in launching sailing dinghies have been, in effect, simplified versions of the road-going trolleys used for towing dinghies behind vehicles for transport over long distances. Such launching trolleys normally comprise a cradle, on which the boat sits, provided with widely spaced wheels and an elongate towbar/manipulating member. In use, the trolley, bearing the dinghy, is pulled down to the water's edge and into the water until the dinghy begins to float, whereupon the trolley must be pulled back out of the water and stored in a safe place ready for use in subsequently beaching the dinghy.

At least two people are required to carry out such a launching operation since one must remain with the dinghy while the other is recovering the launching trolley and returning it to land. The present invention sets out to provide a trolley suitable for transporting a boat, for example for launching purposes, which is simple and cheap to manufacture and which may be readily used by one person both for transporting the boat over short distances as well as launching the boat on to the water.

SUMMARY OF THE INVENTION

According to the invention there is provided a trolley for use in transporting a boat comprising a body element having means for releasably attaching the element to a part of the boat at or near the bottom thereof, a spindle extending through the body element so as to project from opposite sides thereof, and a pair of wheels rotatably mounted on the spindle on opposite sides of the body element.

Using this construction the trolley may be a small unit easily handled by one person. In use it is secured to the keelplate or other lower part of the boat adjacent the stern so that the bow of the boat can then be lifted and the boat pulled along on the wheels of the trolley. The boat may thus be pulled or pushed into the water. When it reaches a position where it begins to float the person carrying out the launching simply removes the trolley from beneath the boat, whilst maintaining a hold on the boat, and stores the unit in the boat ready for use in subsequent beaching.

The body element preferably comprises a unitary block of material shaped to engage said part of the boat. The block is preferably formed from resilient material, such as rubber or synthetic rubber.

The means for releasably attaching said body element to said part of a boat may comprise a metal element projecting from the body element for releasable engagement with said part of the boat. For example, the metal element may be partly embedded within the material of said body element. In one embodiment the metal element comprises a pin projecting from the body element so as to be received, in use, in an aperture on the boat. The pin may include a spring-loaded detent for retaining the pin in said aperture on the boat.

The aforesaid body element may comprise two spaced flanges adapted to straddle the keelplate or other depending part of the boat. The means for releasably attaching the body element to a part of a boat may comprise a releasable detent mounted on said body element and movable relatively thereto into and out of engagement with said part of the boat. For example, the detent may comprise an axially slideable pin engageable in registering holes in said two spaced flanges.

In an alternative arrangement, the body element comprises two spaced members adapted to straddle a depending part of a boat, means being provided for urging the spaced members towards one another, for example by a toggle lever, so that, in use, the depending part of the boat is clamped between them.

In order to spread the load on soft ground, such as sand or mud, said wheels are preferably in the form of rollers. To improve manoeuvrability, each roller may comprise two similar adjacent co-axial roller parts which are rotatable relatively to one another.

DETAILED DESCRIPTION OF THE PREFERRED EMBODIMENTS

Figure 1:
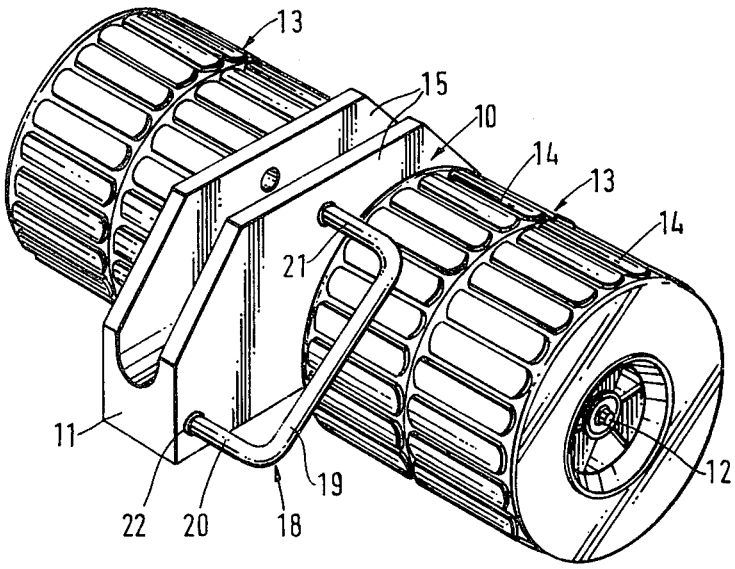
FIG. 1 is a perspective view of one form of trolley in accordance with the invention.

Referring to FIG. 1, the trolley comprises a channel-shaped body element 10 through the web portion 11 of which passes a spindle 12 on the opposite ends of which are mounted hollow plastics rollers 13. Each roller 13 comprises two roller parts 14 which abut one another but which can rotate relatively to one another on the spindle 12.

Figure 2:
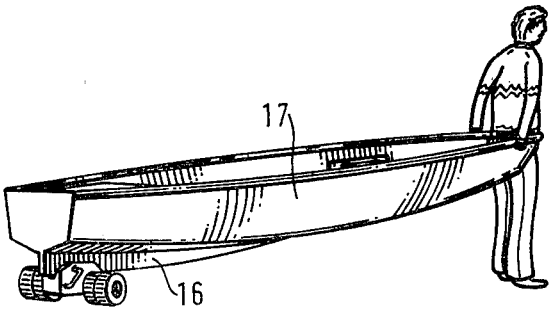
FIG. 2 is a general perspective view of a dinghy fitted with the trolley of FIG. 1, and being transported.

In use, the channel-shaped element 10 is disposed so that the side members 15 of the element straddle the keelplate 16 of the dinghy 17, adjacent the stern thereof (see FIG. 2). A releasable detent 18 is provided to secure the trolley in position on the keelplate. The detent 18 comprises a generally U-shaped member 19 formed from stainless steel, the lower limb 20 of which extends slideably through a fibre tube 22 embedded in the web portion 11 of the channel-shaped element, and the upper limb 21 of which passes through opposed registering holes in the side members 15 of the element.

The lower limb 20 is longer than the upper limb 21 so that when the upper limb 21 is withdrawn from the space between the side members 15, by moving it to the right as seen in FIG. 1, the limb 20 remains within the web portion 11. An abutment (not shown) is formed on the free end of the limb 20 to ensure that the detent 18 remains captive on the element. The keelplate 16 of the dinghy is formed with a hole or elongate slot through which the upper limb 21 passes when in the securing position.

Using the trolley, the dinghy may be transported by lifting the bow and pulling the dinghy along on the trolley as shown in FIG. 2. This way the dinghy can be taken into the water and, once afloat, the trolley may be detached from the keelplate by withdrawing the detent 18. The trolley is then small enough to be stowed in the dinghy itself. As previously mentioned, this operation may be performed by one person.

Preferably the hollow plastics rollers of the trolley are water-tight and are of such a volume that the trolley will float. The trolley may be connected to the dinghy by a line so that it cannot be lost.

Figure 3:
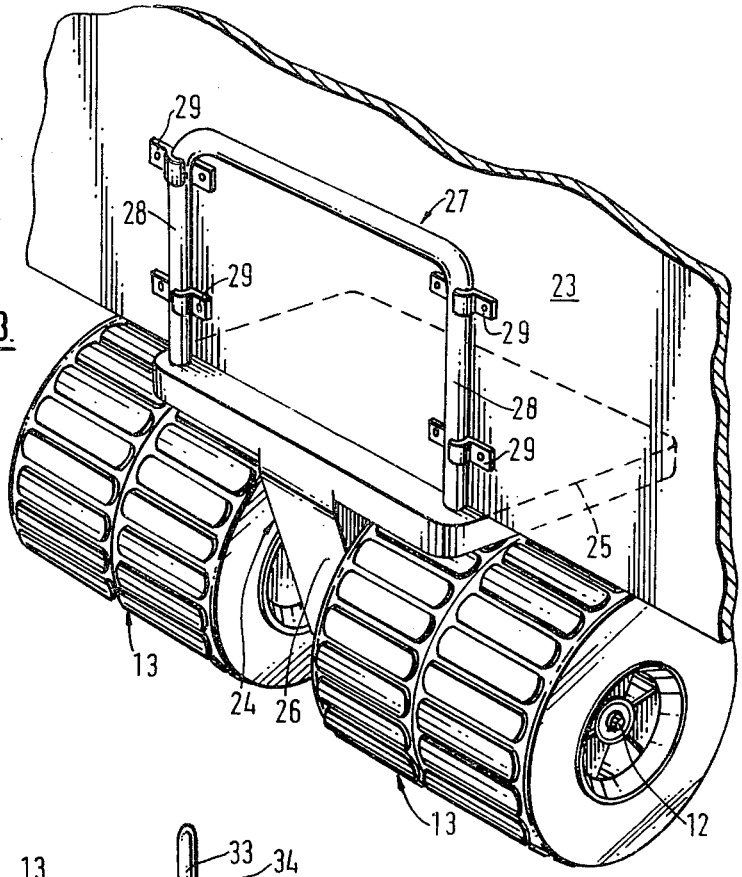
FIG. 3 is a perspective view of an alternative form of trolley fitted to the transom of a dinghy.

FIG. 3 shows an alternative form of trolley suitable for fitting below the transom 23 of a dinghy. In this case the rollers 13 are identical with the rollers of the FIG. 1 arrangement, but the central body element 24 comprises an upper flat portion 25, to engage the underside of the dinghy, with which is integrally moulded a downwardly extending portion 26 through which passes the spindle 12 on which the rollers 13 are mounted.

The trolley is retained in position on the dinghy by an inverted U-shaped rail 27 the lower ends of the limbs 28 of which are moulded into the material of the portion 25 of the element 24. In use, the rail 27 lies flat against the transom 23, as shown, and is located by four spaced clips 29. The clips 29 are so arranged that the limbs 28 may be brought laterally into engagement with the lower clips 29, and then moved vertically to bring the portion 25 into abutting engagement with the underside of the dinghy and the upper parts of the limbs 28 into engagement with the upper clips 29. Spring-loaded balls (not shown) or other spring detent devices may be mounted on the limbs 28 adjacent the upper ends thereof to retain the limbs in engagement with the upper clips 29.

Clips similar to the clips 29 may be mounted on a bulkhead within the dinghy so that the trolley may be mounted on the bulkhead for storage purposes when it is not in use.

In an alternative arrangement (not shown) the rail 27 is replaced by a single vertical pin centrally located adjacent the rear edge of the portion 25 so as to pass through holes in two vertically spaced central brackets mounted on the transom. In this case the pin is again provided with a spring-loaded ball or similar detent device for retaining it in engagement with one or other of the brackets. The upper surface of the portion 25 of the intermediate element may be grooved, recessed or otherwise shaped to fit closely the surface configuration of the part of the underside of the dinghy which it engages.

Figure 4:
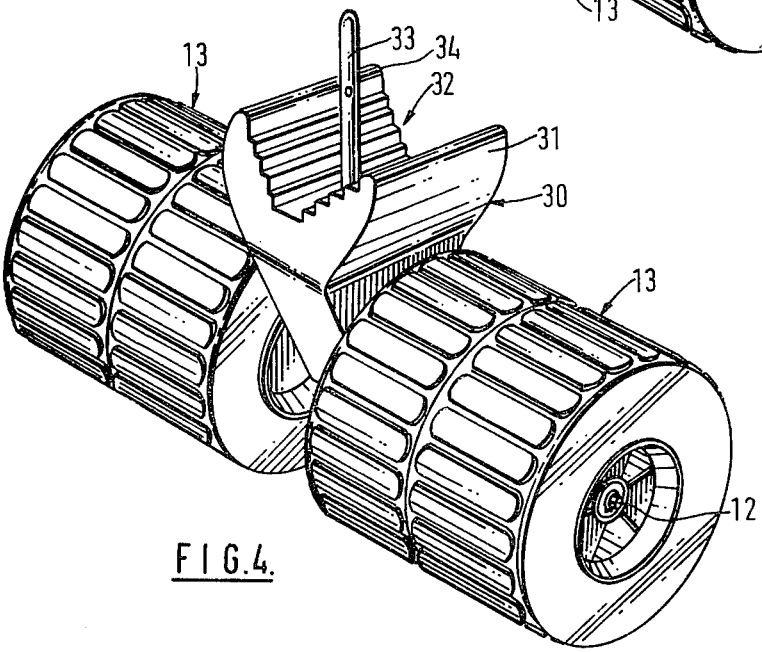
FIG. 4 is a perspective view of a further form of trolley.

The further form of trolley shown in FIG. 4 is suitable for use with dinghies having keelplates and is designed so that it may be fitted to keelplates of various thicknesses. For this purpose the spindle 12 on which the rollers 13 are mounted passes through a fibre bearing tube in the lower part of a body element 30 the upper portion 31 of which is formed with a step-sided groove 32 which, in use, engages the lower edge of the keelplate, the stepped arrangement of the sides of the groove ensuring that it closely embraces the keelplate. It will be appreciated that a similar effect might be obtained by providing the groove 32 with straight sloping sides.

Projecting upwardly from the bottom of the groove 32 is a stainless steel pin 33 which is inserted into a vertical hole in the keelplate so as to locate and secure the trolley in position on the keelplate. The hole may be lined with a bearing tube, and a spring-loaded ball 34 is mounted on the pin 33 and is engageable with a depression or slot on the interior of the tube within the keelplate to retain the pin within the tube. Alternatively, the resilient pressure of the ball 34 against the wall of the tube or hole in the keelplate may alone be sufficient to retain the pin within the tube or hole.

In any of the arrangements shown in FIGS. 1 to 4, the central body element may be formed from wood, metal or any other suitable material, but is preferably formed from a resiliently flexible material such as hard rubber or synthetic rubber having a Shore hardness in the range of 65 to 80. The spindle 12 is preferably formed from stainless steel and where the spindle passes through the element 10 it is preferably surrounded by a fibre bearing tube so as to spread the load on the material of the element 10.

The purpose of the resilience of the body element is to prevent damage to the part of the boat to which the trolley is fitted due to loads imparted to the trolley during use, for example as a result of hitting an obstruction.

Figure 5:
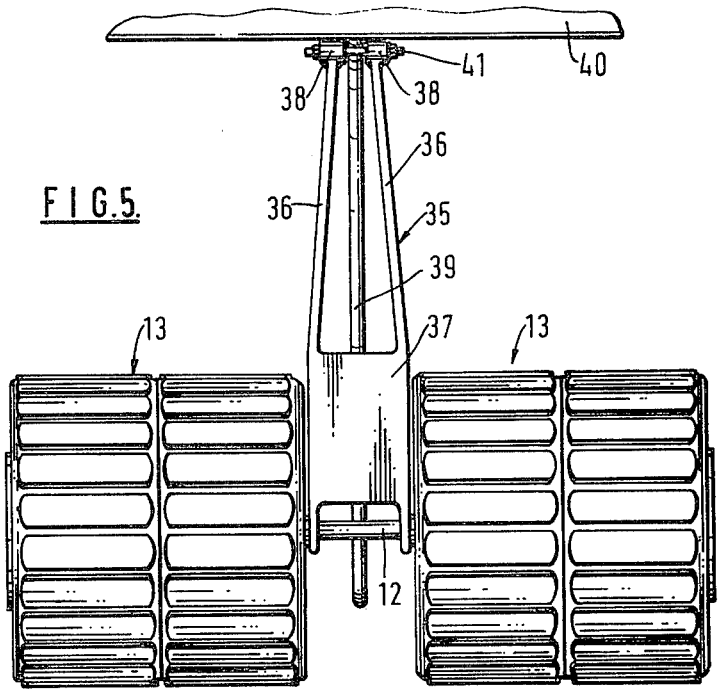
FIG. 5 is a front view of a still further form of trolley suitable for use with a surfboard.
Figure 6:
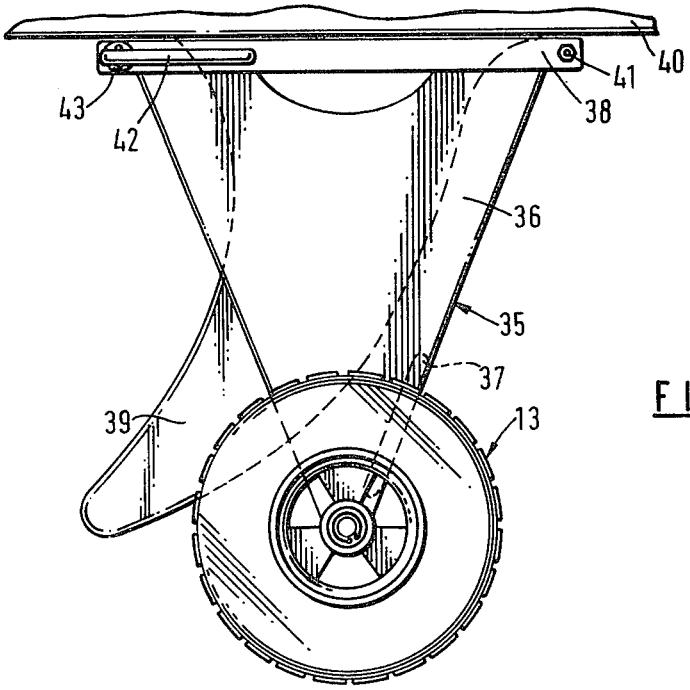
FIG. 6 is a side elevation of the trolley shown in FIG. 5.

FIGS. 5 and 6 show a trolley suitable for use with a surfboard, wind-surfing board, or any other vessel having a depending fin.

In this arrangement the body element 35 between the rollers 13 comprises two generally triangular side plates 36 connected by a cross plate 37. The side plates 36 are formed from resilient metal such as sheet steel and have secured along the upper edges thereof square section metal bars 38. Alternatively, the upper edges of the plates 36 themselves may be folded over or otherwise shaped to provide jaws for gripping the sides of the fin 39 on a surfboard or other vessel indicated at 40.

Adjacent ends of the bars 38 are connected by threaded rods 41 and one of the threaded rods has pivotally connected to it a toggle lever 42 which when swung horizontally bears against a shaped washer 43 to urge the ends of the bars 38 together. Thus, in use, with the toggle lever 42 in the position shown in FIG. 6 and the plates 36 separated, the trolley is positioned so that the plates 36 of the element 35 are on opposite sides of the fin 39. The toggle lever 42 is then operated to move the two bars 38 towards one another so as tightly to clamp the upper part of the fin 39, as shown in FIG. 5.

The bars 38, or shaped edges of the plates 38 where such are provided, are preferably padded to prevent damage to the fin 39. For example the whole element 35 may have applied thereto a thick coating of plastics material.

There may be provided on the upper surface of the surfboard an upward projection on which the trolley may be clamped when not in use for manoeuvring the surfboard.

Figure 7:
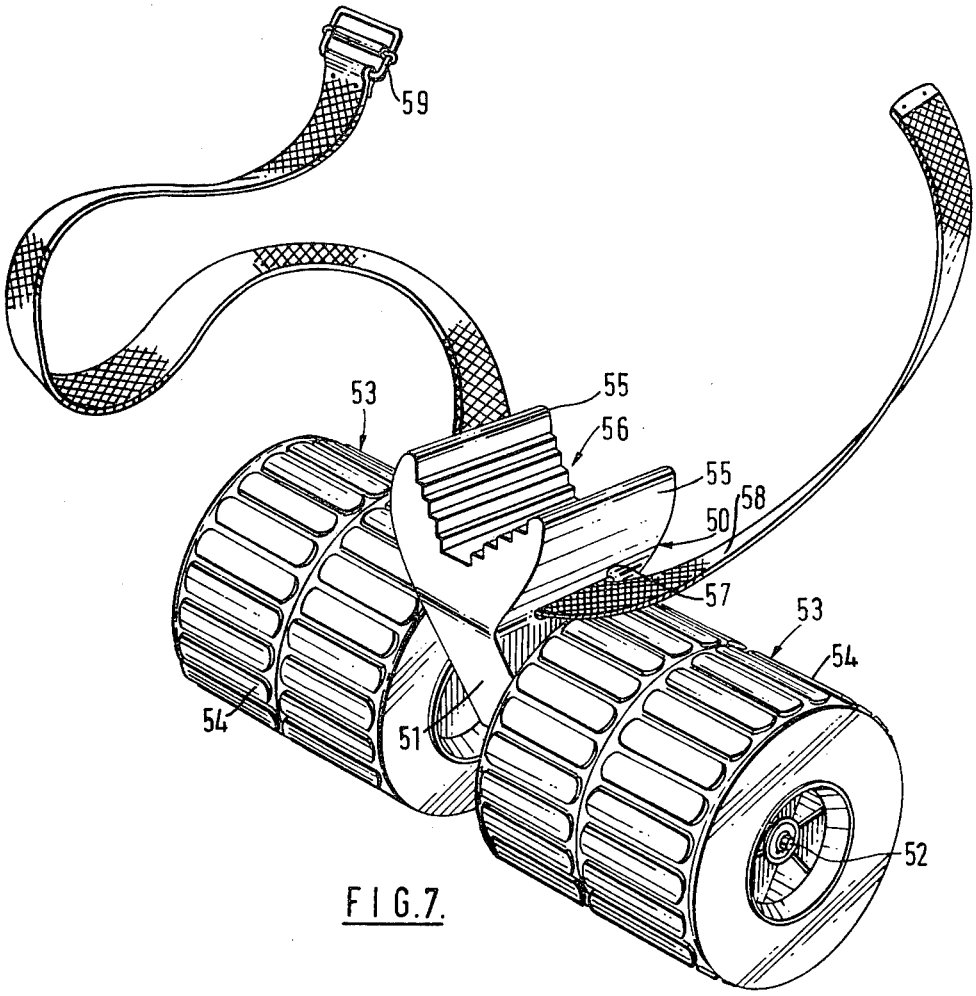
FIG. 7 is a perspective view of a further form of trolley.

In the forms of trolley shown in FIGS. 1 to 4 the means for releasably attaching the trolley to the boat comprise projecting elements for engagement with a part of the boat. Thus, the boat itself will normally require to be provided with some means, such as clips or a drilled hole, for receiving and retaining the projecting part of the trolley. FIG. 7 shows a form of trolley which may be attached to many different types of boat without any necessity of modifying the boat or providing special fittings thereon.

Referring to FIG. 7, the trolley comprises a body element 50 through the lower portion 51 of which passes a spindle 52 on the opposite ends of which are mounted hollow plastics rollers 53. Each roller 53 comprises two roller parts 54 which abut one another but which can rotate relatively to one another on the spindle 52. The spindle 52 passes through a fibre bearing tube (not shown) mounted in the lower portion 51 of the body element.

The upper portion of the body element 50 comprises two spaced flanges 55 between which is formed a step-sided groove 56 which, in use, engages the lower edge of the keelplate or other part of the boat to which the trolley is to be fitted. The stepped arrangement of the sides of the groove ensures that it closely embraces the keelplate whatever its thickness.

At the junction between the flanges 55 and the lower portion 51, the body element is formed with a transverse slot 57 of elongate cross-section which passes wholly through the body element 50.

Passing through the slot 57 is a flexible strap 58 which is preferably formed of water-resistant woven material such as woven plastics material, or any other suitable form of flexible water-resistant material.

One end of the strap 58 has connected thereto a buckle 59 with which the opposite end of the strap may be engaged.

In use, the trolley is located in a suitable position on the boat, for example with the keelplate received in the groove 56, and the two free ends of the strap 58 are wrapped around the hull of the boat and buckled together and drawn tightly to pull the trolley firmly into engagement with the keelplate. Instead of being connected to the keelplate the trolley may, of course, be mounted on any other suitable part of the boat. For example, where the trolley is to be used with a surfboard the surfboard may be turned on its side and one edge of the board inserted in the groove 56, the ends of the strap 58 being buckled together at the opposite side edges of the surfboard.

Instead of the strap 58 passing through a slot in the body element 50 it may be connected to the body element in any other suitable manner. Instead of being in the form of a single continuous strap having two free ends, there may be provided two separate straps each connected to the body element at one end thereof.

In some cases it may not be possible to wrap the strap around the whole of the hull of the boat to connect the two ends of the strap together, and in such cases it may be necessary to tie or otherwise attach each end of the strap separately to a fixed part of the boat, such as a cleat.

All the above arrangements provide a compact trolley which permits easy handling and manoeuvrability of the vessel to which it is connected and which may be readily fitted and then removed and stowed in a comparatively small space, such as on the vessel itself.

It will be appreciated that forming each roller 13 in two portions 14 improves the manoeuvrability of each trolley. Since the trolleys are preferably formed from plastics and stainless steel they will not be subject to rust or corrosion.

I claim:

1. A trolley for use in transporting a boat, comprising a body element formed from a unitary block of resilient material shaped to engage a part of the boat at the bottom thereof, a metal retaining element projecting from the block of resilient material and adapted for releasable engagement with said part of the boat, so as to secure the trolley to the boat, a spindle extending through the block of resilient material so as to project from opposite sides thereof, and a pair of wheels rotatably mounted on the spindle on opposite sides of the block of resilient material, the block being T-shaped and having a horizontal cross piece that overlies said wheels and a vertical stem through which said spindle extends, said metal retaining element being of inverted U-shape having two upright legs whose upper ends are interconnected and whose lower ends are embedded in opposite ends of said horizontal cross piece said U-shaped element being disposed in a plane parallel to the axes of said wheels.

2. A trolley according to claim 1, wherein said resilient material is rubber.

3. A trolley according to claim 1, wherein said wheels are in the form of rollers, each roller comprising two similar adjacent co-axial roller parts which are rotatable relatively to one another.

* * * * *